United States Patent [19]

Marcantel

[11] Patent Number: 5,011,228

[45] Date of Patent: Apr. 30, 1991

[54] COLLAPSABLE/STACKABLE ARTICLE OF FURNITURE

[76] Inventor: Gerald Marcantel, 4708 S. Irving Ave., Tucson, Ariz. 85714

[21] Appl. No.: 411,318

[22] Filed: Sep. 22, 1989

[51] Int. Cl.[5] ..... A47C 4/00; A47B 3/06

[52] U.S. Cl. ..... 297/442; 297/157; 297/170; 297/174; 297/172; 108/101

[58] Field of Search ..... 297/159, 157, 170, 17, 297/217, 442, 440, 174, 172; 108/33, 34, 41, 111, 101

[56] References Cited

U.S. PATENT DOCUMENTS 2,486,987 11/1949 Scarlett ..... 297/442

4,506,466 3/1985 Hall ..... 108/111 X 4,509,794 4/1985 Roland ..... 297/442 X 4,740,032 4/1988 Olsen et al. ..... 108/111 X

*Primary Examiner*—Peter R. Brown

*Attorney, Agent, or Firm*—Mark E. Ogram

[57] ABSTRACT

A knock-down or collapsible article of furniture which, in a disassembled state, utilizes some of its components to interlock and create a storage package for the remainder of the components. In the disassembled state, two side panels operate in conjunction with a support member and a locking key to create a box or envelope that holds the remaining pieces of the article of furniture.

10 Claims, 2 Drawing Sheets

COLLAPSABLE/STACKABLE ARTICLE OF FURNITURE

BACKGROUND OF THE INVENTION

Figure 1A:
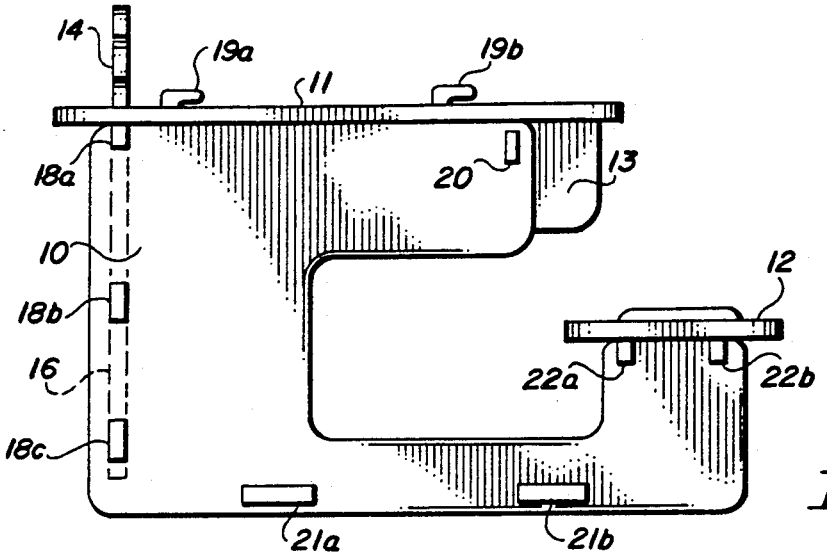

This invention relates generally to furniture and more particularly to collapsible furniture commonly known as "knock-down" furniture.

Collapsible/knock-down furniture is usually constructed of plywood or other planar material. Each piece interlocks with another through the use of hooks and slots or simple extensions and slots. Once the pieces are assembled and interlocked, an article of furniture is created which is extremely sturdy and durable.

The planar nature of the components make knock-down or collapsible furniture ideal for temporary use permitting the disassembled unit to be easily and conveniently stored between uses.

Examples of such furniture include desks, picnic tables, chairs, rocking chairs, and the like.

The advantage of such furniture is twofold: (i) they are relatively inexpensive to manufacture; and, more importantly (ii) the disassembled unit is easy to store due to the planar nature of the components which take up little space when placed parallel to each other.

Although great strides and tremendous innovation have been devoted relative both in the creation of the furniture itself and in novel ways to lock the various pieces together as a final piece of furniture, little has been done relative to the storage aspect of the disassembled pieces.

As noted above, collapsible or knock-down furniture typically is stored until it is actually put in use. This means not only the placement of the disassembled unit in a convenient location, but also the transportation of the disassembled unit to the place of use.

Traditionally, the owner keeps the original cardboard shipping box or other such container for use in storing and transporting the disassembled unit. As time passes and the cardboard box is used more, it becomes less and less secure, eventually ripping and permitting the contents to be lost or strewn about.

In some situations, a separate wooden box accompanies the disassembled unit and is used for the sole purpose of storing the unit when it is not in use.

It is clear from the forgoing that either solution is not ideal and that an efficient solution to the storage and/or transportation problems does not exist.

SUMMARY OF THE INVENTION

The present invention utilizes parts of the collapsible unit itself to create a storage container for holding the remainder of the pieces. In this manner, parts of the furniture function both in the assembled state and in the disassembled state.

Although the present discussion is in terms of a shooting bench, those of ordinary skill in the art will readily recognize the invention's application to other articles of furniture.

A shooting bench is substantially a desk or bench arrangement permitting the shooter to use the top of the bench as support and for steadying the firearms during practice. The shooting bench has two side panels, a top, a seat, and miscellaneous support members.

This invention utilizes some of the pieces of the furniture to function not solely as a unit of furniture; but, also as components in a container or carrying case arrangement. In the preferred embodiment, the side panels, a support member, and a key are used to create a container or carrying case.

In the disassembled state of the preferred embodiment, the support member connects one edge of each of the side panels to each other. The support member and the two side panels form three sides of a box. Other pieces of the shooting bench are collected and placed in the envelope formed by the support member and the two side panels.

The opposite edge of the two panels is secured to each other by a key member. In the preferred embodiment of the invention, this key member is also a part of the assembled shooting bench and serves as a rifle support member in the assembled state.

Because of the planar aspect of the component parts, the envelope needed for the storage of the disassembled unit is minimal. The dimensions of the dual purpose support member are chosen so that the contained pieces within the envelope are squeezed slightly once the container is secured; thereby creating a frictional force between the components to prevent the loose pieces from falling out.

The invention, together with various embodiments thereof will be more clearly defined and explained by the following drawings and their accompanying descriptions.

DRAWINGS IN BRIEF

Figure 1B:
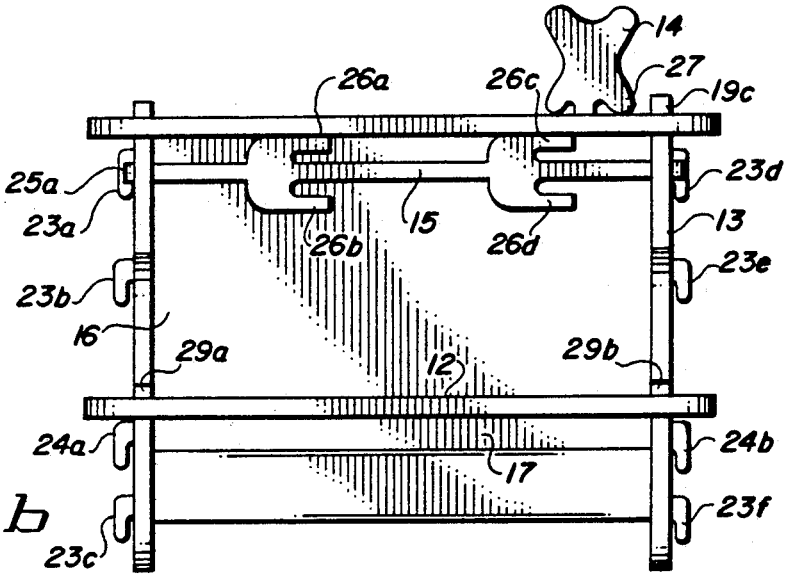

FIGS. 1*a* and 1*b* are side and frontal views, respectively, of the preferred embodiment of the invention in its assembled state ready for use as a shooting bench.

Figure 2A:
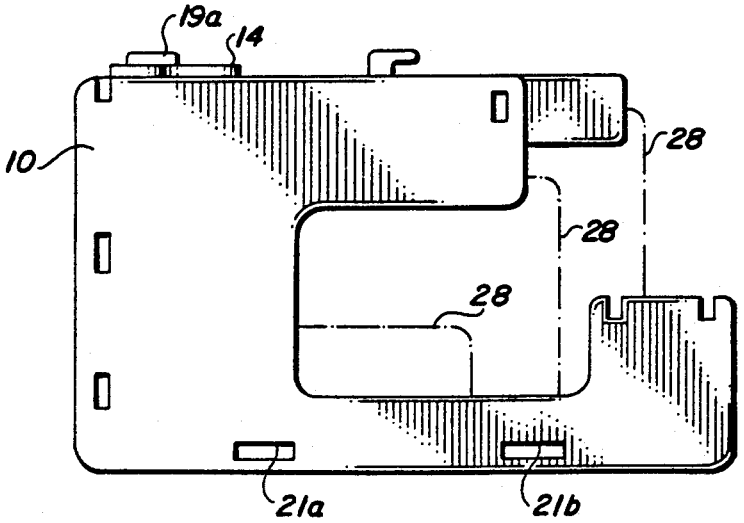
Figure 2B:
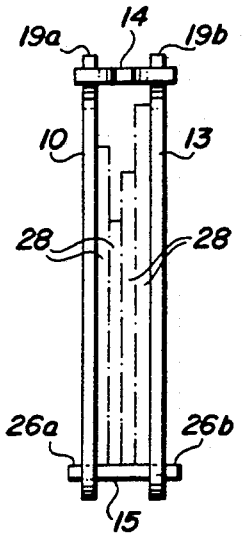

FIGS. 2*a* and 2*b* are side and frontal views, respectively, of the preferred embodiment of the invention illustrated in FIGS. 1*a* and 1*b* in its disassembled state ready for storage or transportation.

Figure 3A:
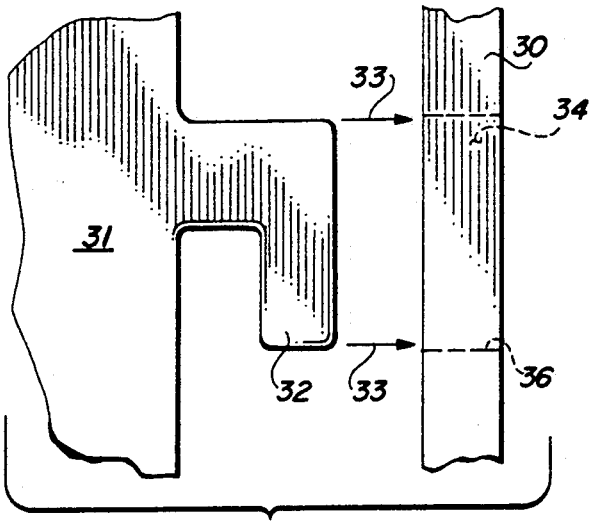
Figure 3B:
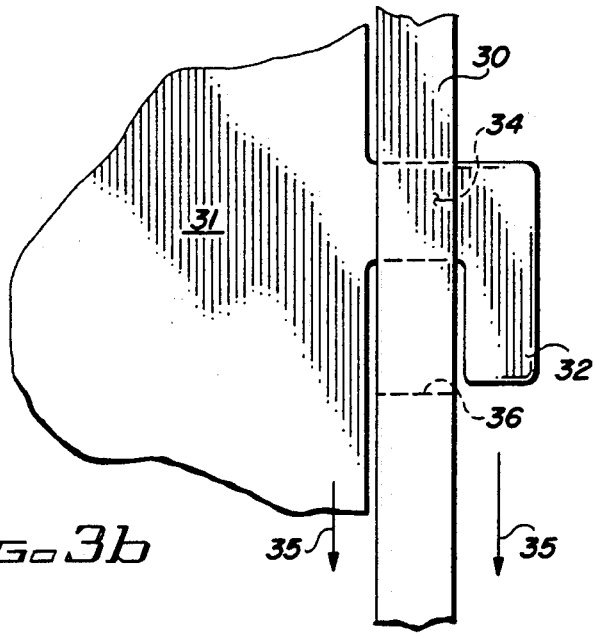
Figure 3C:
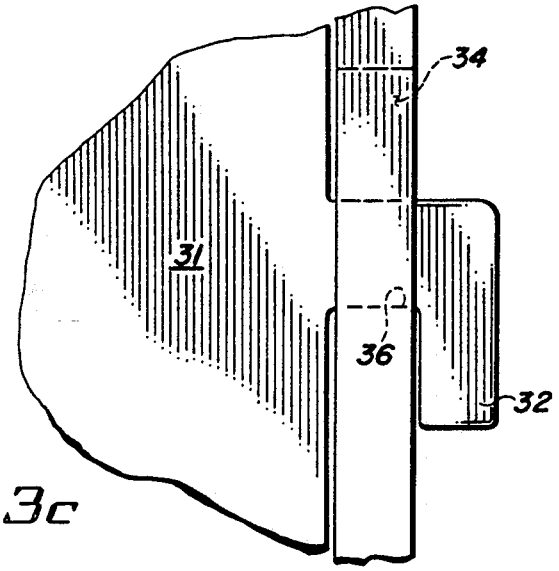

FIGS. 3*a*, 3*b*, and 3*c* illustrate the preferred locking mechanism of the invention.

DRAWINGS IN DETAIL

FIGS. 1*a* and 1*b* illustrate a shooting bench as the preferred embodiment of the invention in its assembled state.

The basic components of the shooting bench are side panel 10, side panel 13, desk top 11, support/key 14, top support member 15, front panel 16, seat 12, and seat support member 17. All of the components are planar in nature and are bound to each other without external fasteners. This permits the shooting bench to be easily and quickly disassembled for storage or transportation.

In this embodiment, side panel 10 and side panel 13 are the main components which support or bind the remaining components. As is illustrated by FIG. 1*a*, side panel 10 has numerous fastening devices permitting the other components to lock thereinto.

Female slots 18*a*, 18*b*, and 18*c* permit the male extensions/hooks 23*a*, 23*b*, and 23*c* to fit thereinto and secure front panel 16 to side panel 10. In a similar manner, male hooks 23*d*, 23*e*, and 23*f* secure the front panel 16 to side panel 13.

Males extensions/hooks 19*a* and 19*b*, located on side panel 10 affix desk top 11 to side panel 10. Similarly, male extension/hook 19*c* and another male extension (not shown) affix the desk top 11 to side panel 13.

Desk top 11 is supported around its periphery by side panel 10, side panel 13, front panel 16, and top support member 15. Top support member 15 has male extensions 25*a* and 25*b* which extend through side panel 10 and side panel 13 respectively.

In one embodiment of the invention, holes or orifices are drilled through the desk top. These holes provide support for loaded and spent cartridges.

Top support member 15 is one of the components of the shooting bench of this illustration that serves a dual purpose; that is, it not only forms a part of the assembled shooting bench, but also a part of the container for the disassembled shooting bench (illustrated and explained in FIGS. 2*a* and 2*b*).

Top support member 15 has male hooks 26*a*, 26*b*, 26*c*, and 26*d* extending along its side. As illustrated, male hooks 26*a* and 26*c* provide support to one edge of desk top 11. These male hooks 26*a*, 26*b*, 26*c* and 26*d* are used in creating the container state of the invention.

Support/Key 14 is equipped with a male extension which protrudes through a female slot (not shown) on desk top 11. Support/Key 14 is another component of the shooting bench that serves a function not only in the assembled state but also in the disassembled state. Support/Key 14 is equipped with locking mechanism 27 which is used in the disassembled form illustrated in FIGS. 2*a* and 2*b*.

Seat member 12 is secured to side panel 10 and side panel 13 via male extensions 29*a* and 29*b*. Support for seat member 12 is supplied by seat support 17 which locks with side panel 10 and side panel 13 via male extension/hooks 24*a* and 24*b* extending through female slot 22*b* on side panel 10 and a female slot (not shown) on side panel 13.

The four components that serve functions in both the assembled state and the disassembled state are the support/key 14, top support member 15, side panel 10, and side panel 13. Side panel 10 also contains female slots 21*a* and 21*b* which are used in the disassembled state. A similar pair of female slots exist in side panel 13 but are not shown.

FIGS. 2*a* and 2*b* illustrate the same shooting bench of FIGS. 1*a* and 1*b*, except that the shooting bench has been disassembled and is arranged for storage.

The various components of the shooting bench are either part of the container or are enclosed within the envelope formed by the container. In this manner, the entire shooting bench can be secured in one package.

The container is created by using top support member 15 to bind side panel 10 to side panel 13. Male extension 26*a* extends through female slot 21*a* in side panel 10 (male extension 26*c* extends through female slot 21*b* but is not shown in this view); and, male extension 26*b* extends through a similar female slot in side panel 13.

Top support member 15, side panel 10, and side panel 13 form three sides of the container. Support/Key 14, by locking the opposite edge of side panel 10 and side panel 13 completes the container and forms an envelope therein.

Within this envelope, the remaining components are secured, shown here in abstract 28. These components are secured through a slight "pinching" caused by the container. This "pinching" creates sufficient friction so that the components within the envelope do not slip out during transportation.

The preferred locking mechanism is illustrated in FIGS. 3*a*, 3*b*, and 3*c*.

The first step of locking two members 30 and 31 to each other is illustrated in FIG. 3*a*. Member 31 has a male extension/hook 32 attached thereto. This extension is slipped (as illustrated by arrows 33) through a female slot 34 in member 30.

Then, as illustrated in FIG. 3*b*, member 31 is moved in the direction of arrows 35, forcing the male extension/hook 32 to overlap member 30 at the lowest point 36 of female slot 34.

This creates the arrangement illustrated in FIG. 3*c* wherein hook 32 is secured on one side of member 30 while member 31 remains on the other side. Secure bonding (or mating) is obtained between member 31 and member 30 is thus achieved.

Those of ordinary skill in the art readily recognize other suitable methods of attaching or mating the various planar components of the collapsible furniture utilizing this invention.

Although the present discussion has been in reference to a shooting bench, those of ordinary skill in the art readily recognize the present invention's ability to be used in such collapsible furniture as desks, lockers, picnic tables, etc.

It is clear from the forgoing that the present invention provides a more useful and portable collapsible piece of furniture.

What is claimed is:

1. A portable shooting bench capable of being disassembled comprising:

(a) two side panels, each of said side panels having, (1) a table support portion having a front edge, a top edge, and a rear edge, said front edge having at least two female attachment slots, said rear edge having at least one female attachment slot, and said top edge having at least two male extensions, (2) a seat support portion having at last one male extension thereon along a top edge, and (3) a bottom portion connecting a lower part of said table support portion and a lower part of said seat support portion and having, at least two female attachment slots therein;

(b) a seat panel having at least one female attachment slot at each end, each of said female attachment slots of said seat panel mating with one of said male extensions of said seat support portion of each side panel;

(c) a table top panel having at least two female attachment slots at each end, each of said female attachment slots of said table top panel mating with said male extensions of said top edges of said table support portion of each side panel;

(d) a front panel having at least two male extensions at each end, each of said male extensions of said front panel mating with one of said female attachment slots of the front edges of said table support portion of each side panel;

(e) a top support panel member having, (1) at least two male extensions of each end mating with one of said female attachment slots of said rear edges of said table support portion of each side panel, (2) at least four male extensions located along side edges of said top support panel member being mateable, in the disassembled state, to said at least two female attachment slots of said bottom portion of each side panel; and, (f) a locking key formed from an elongated member having at least one locking mechanism along each side and for selectively securing at least one male extension of each of said side panels whereby in the disassembled state, the two side panels, the top support panel, and the locking key form an envelope for storage of the remaining panels.

2. The portable shooting bench according to claim 1 wherein said table top further includes a female slot and wherein said locking key further includes a male extension for insertion into the female slot of said table top.

3. The portable shooting bench according to claim 2 further comprising two seat support members, each of said seat support members having a males extension thereon, and wherein each of the seat support section of said side panels has a female slot for mating to one of the male extensions of said seat support members.

4. The portable shooting bench according to claim 3 wherein said table top includes at least two bullet support orifices therein.

5. The portable shooting bench according to claim 4 wherein said side panels, said seat, said table top, said top support member, said locking key, and said seat support members are all planar.

6. A kit for a portable shooting bench capable of being disassembled comprising:

(a) two side panels, each of said side panels having, (1) a table support portion having a front edge, a top edge, and a rear edge, said front edge having at least two female attachment slots, said rear edge having at least one female attachment slot, and said top edge having at least two male extensions, (2) a seat support portion having at least one male extension thereon along a top edge, and (3) a bottom portion connecting a lower part of said table support portion and a lower part of said seat support portion and having, at least two female attachment slots therein;

(b) a seat panel having at least one female attachment slot at each end, each of said female attachment slots of said seat panel mating with one of said male extensions of said seat support portion of each side panel;

(c) a table top panel having at least two female attachment slots at each end, each of said female attachment slots of said table top panel mating with said male extensions of said top edges of said table support portion of each side panel;

(d) a front panel having at least two male extensions at each end, each of said male extensions of said front panel mating with one of said female attachment slots of the front edges of said table support portion of each side panel;

(e) a top support panel member having, (1) at least two male extensions of each end mating with one of said female attachment slots of said rear edges of said table support portion of each side panel, (2) at least four male extensions located along side edges of said top support panel member being mateable, in the disassembled state, to said at least two female attachment slots of said bottom portion of each side panel; and, (f) a locking key formed from an elongated member having at least one locking mechanism along each side and for selectively securing at least one male extension of each of said side panels whereby in the disassembled state, the two side panels, the top support panel, and the locking key form an evelope for storage of the remaining panels.

7. The kit for a portable shooting bench according to claim 6 wherein said table top further includes a female slot and wherein said locking key further includes a male extension for insertion into the female slot of said table top.

8. The kit for a portable shooting bench according to claim 7 further comprising two seat support members, each of said seat support members having a males extension thereon, and wherein each of the seat support section of said side panels has a female slot for mating to one of the male extensions of said seat support members.

9. The kit for a portable shooting bench according to claim 8 wherein said table top includes at least two bullet support orifices therein.

10. The kit for a portable shooting bench according to claim 9 wherein said side panels, said seat, said table top, said top support member, said locking key, and said seat support members are all planar.

* * * * *